United States Patent [19]

Miura

[11] 4,308,981

[45] Jan. 5, 1982

[54] CLIP HANGER

[76] Inventor: Shozo Miura, 1012 Osayuki, Kokuraminami-Ku, Kitakyushu-shi, Fukuoka, Japan

[21] Appl. No.: 95,046

[22] Filed: Nov. 16, 1979

[30] Foreign Application Priority Data

Jun. 30, 1978 [JP] Japan ..... 53-90981

[51] Int. Cl.[3] ..... A47J 51/142

[52] U.S. Cl. ..... 223/96; 24/137 A; 24/260; 24/344

[58] Field of Search ..... 24/84 H, 260, 137 A, 24/344; 223/85, 87, 91, 93, 96; D6/252, 253

[56] References Cited

U.S. PATENT DOCUMENTS

| | | | |
|---|---|---|---|
| 852,951 | 5/1907 | Harnischfeger | 223/96 X |
| 3,120,331 | 2/1964 | Brooke | 223/91 |
| 3,745,616 | 7/1973 | Batts | 223/96 X |
| 3,923,213 | 12/1975 | George et al. | 223/96 |
| 3,963,154 | 6/1076 | Schwartz et al. | 223/85 |
| 4,169,549 | 10/1979 | Takagi | 223/96 |

FOREIGN PATENT DOCUMENTS

| | | | |
|---|---|---|---|
| 24491 | 5/1919 | Denmark | 223/96 |
| 227647 | 1/1925 | United Kingdom | 223/85 |

*Primary Examiner*—Robert Mackey
*Attorney, Agent, or Firm*—Jordan and Hamburg

[57] ABSTRACT

A clip hanger for suspending trousers or skirts especially used in laundries. The clip hanger comprises an inverse V-shaped clip body having two resilient clamp arms, a resilient hook mounted on an upper hook mounting base of the clip body and a resilient loop which is disposed around the clamp arms so as to narrow an acute angle of the clamp arms when in used. With the simple narrowing operation, a desired clamping force is exerted between the clamping ends of the clamp arms without necessitating a metal spring means which a conventional clip hanger requires for clamping purposes.

6 Claims, 6 Drawing Figures

CLIP HANGER

BACKGROUND OF THE INVENTION

This invention relates to an improved type of clip hanger which can firmly grip one end of trousers or skirts, thus suspending the trousers and skirts therefrom, and more particularly clip hangers which may be used as disposable hangers in laundries.

Conventionally, there have been devised various types of clip holders for the above purpose. One of such conventional clip holder is disclosed in Japanese utility model publication No. SHO52-50914. However, such device necessitates a metal spring for imparting a resiliency to the clamping arms, whereby the entire construction of such clip hangers becomes cumbersome and complicated incurring costly production thereof.

Accordingly, it is an object of the present invention to provide a clip hanger which can be produced cheaply without deteriorating the firm clamping force thereof.

It is another object of the present invention to provide a clip hanger which is free from rust or corrosion.

DETAILED DESCRIPTION OF THE DISCLOSURE

The clip hanger of this invention is hereinafter disclosed in conjunction with the attached drawings, FIG. 1 to FIG. 6.

Figure 1:
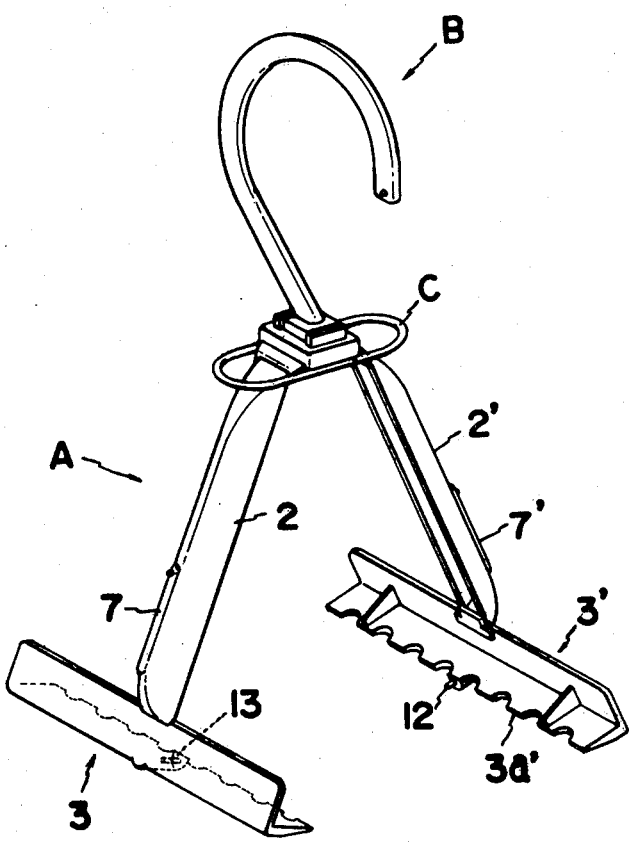
FIG. 1 is a perspective view showing the clip hanger of this invention in an open position.

In the drawings, reference A indicates a clip body which is made of resilient material such as plastic. The clip body A substantially comprises a rectangular-shaped hook mounting base (1), a pair of elongated clamp arms (2) (2') symmetrically extending downwardly from the hook mounting base (1) and a pair of lateral clamps (3) (3') which are connected perpendicularly to the lower ends of the respective elongated clamp arms (2)(2'). In the above construction, the hook mounting base (1) is provided with an opening (4) which engages with a lower resting portion (5) of a hook means (B) which will be described later in detail. The elongated clamp arms (2)(2') which have a U-shaped cross section and a width narrower than that of the base (1) have their upper ends connected with both lateral sides of the rectangular-shaped hook mounting base (1) by way of thin flexible flat joint members (6)(6'). Due to the flexibility of the joint members (6)(6'), the elongated clamp arms (2)(2') are folded in both inward and outward directions, wherein when they are folded inwardly, the lateral clamps (3)(3') engage with each other. However, since the joint members (6)(6') are also made of the resilient material, the elongated clamp arms (2)(2') take an expanded position as shown in FIG. 1 due to the resiliency (repulsive force) of the joint members (6)(6').

It is also noted that the hook mounting portion (1) is provided with a pair of protrusions (14)(14') on the bottom thereof and the flexible joint members (6)(6') have other protrusions (15)(15') on the bottom thereof which come into contact with protrusions (14)(14') when the clamp arms (2)(2') are folded inwardly. Due to such construction, the minimum folding angle of the clamp arms (2)(2') can be defined. Reinforcing ribs (7)(7') may be formed on and along the elongated clamp arms (2)(2') so as to reinforce the rigidity and the resiliency of the arms (2)(2'). The lateral clamps (3) (3') have an L-shaped cross section such that free ends of the horizontal portion (3*a*)(3*a'*) which work as clamping edges face each other. The free ends of the lateral clamps (3)(3') are provided with a serrated surface such that the clamping force exerted between the free ends of the lateral clamps (3) (3') can be fully utilized for suspending skirts or trousers. The free ends of the lateral clamps (3)(3') are also provided with a protrusion (12) and a recess (13), respectively. These members assure and facilitate the quick and accurate engagement of the free ends.

As described above, the reference (B) indicates a hook means which is also made of resilient material such as synthetic resin or plastic. As can be readily understood from FIG. 6, the hook means (B) is provided with a rotatable shaft (8) which is rotatably engaged in the opening (4) formed on the hook mounting base (1) and an inverse-cone-shaped latch member (9) which has a diameter greater than that of the rotatable shaft (8) as well as the opening (4). In mounting the hook means (B) on the hook mounting base (1), the latch member (9) is forcibly inserted into the opening (4) against the resiliency of the hook mounting base (1).

Since the latch member (9) and hook mounting base (4) are both made of resilient material, the latch member (9) can biasingly pass through the opening (4) and, after passing, the latch member prevents the hook means (B) from separating from the clip body (A) although the latch member allows the rotation of the hook means (B) relative to the clip body (A). For restricting the free rotation of the hook means (B) relative to the clamp body (A), the hook means (B) is provided with a square member (10) above the rotatable shaft (8) while parallelly-spaced apart resilient elongated protrusions (11) (11') are formed on the hook mounting base (1). The space between (11)(11') is determined such that the space is wider than the width of the square member (10) but narrower than the diagonal length of the square member (10). Due to such construction, the hook means (B) usually takes a fixed position relative to the clip body (A) and only in case the change of the position relative to the clip body (A) is required due to the change of the conditions for use, the hook means (B) is rotated integrally with the square member (10) against the resiliency of the elongated protrusions (11)(11') taking a new fixed position relative to the clip body (A).

Figure 2:
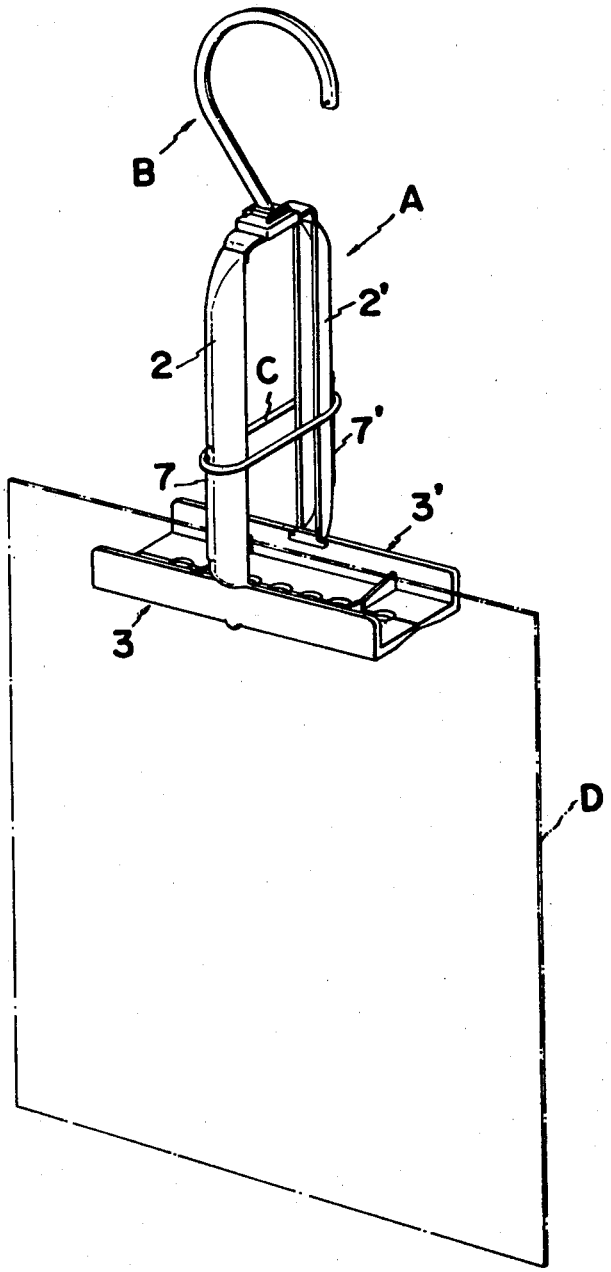
FIG. 2 is a perspective view showing the clip hanger in use.
Figure 3:
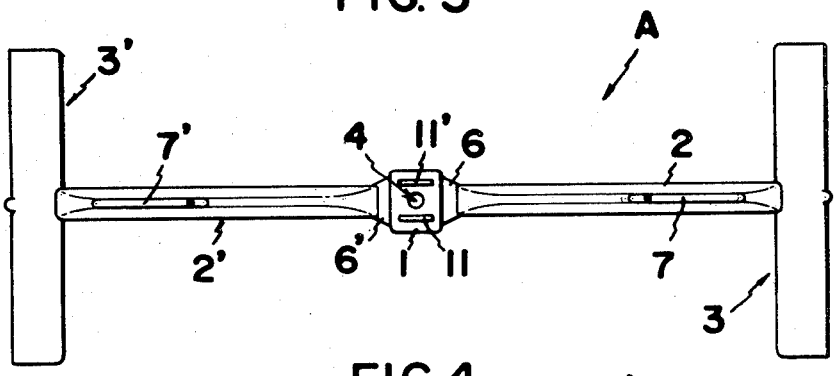
FIG. 3 is a plan view of the clip body in the molding stage.
Figure 4:
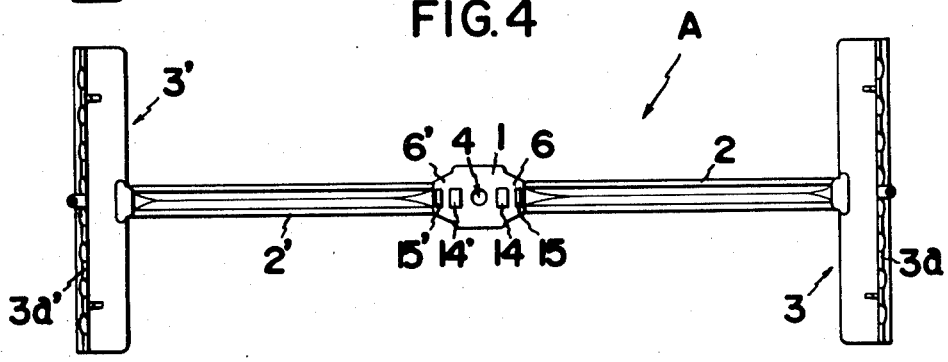
FIG. 4 is a bottom view of the clip body shown in FIG. 3.
Figure 5:
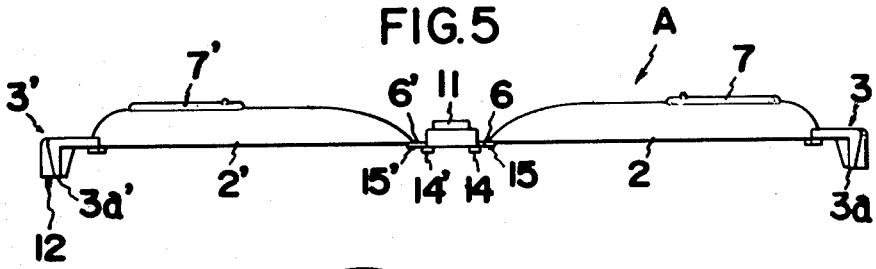
FIG. 5 is an elevational view of the clip body shown in FIG. 3.
Figure 6:
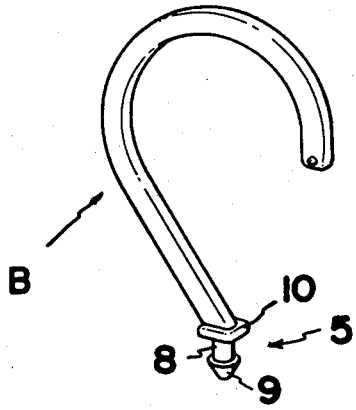
FIG. 6 is a perspective view showing the hook employed in the clip hanger of this invention.

Reference (C) indicates an elongated circular loop of a circular cross section which is also made of a resilient material such as synthetic resin or plastic. Such elongated circular loop (C) substantially has a longitudinal inner width which is narrower or equal to the distance between the outer peripheries of the clamp arms (2)(2') when lateral clamps (3) (3') are completely engaged with each other and a lateral inner width equal to the width of the clamp arms (2)(2'). In operation, when the clip hanger of this invention is not in use, the elongated loop (C) takes a loosened position as shown in FIG. 1. while when the clip hanger of this invention is in use, the elongated loop (C) takes a clamping position as shown in FIG. 2 where one end of a trouser (D) is biasingly clamped between free ends of the lateral clamps (3) (3') due to the resilient force which is exerted on the elongated clamp arms (2)(2') and the elongated loop (C) as well as the resilient force of the joint members (6)(6'). It must be also noted that since the lateral inner width of the loop (C) is narrower than the width of the hook holding base (1), removal of the loop (C) from the clip body (A) can be easily effected.

The manner in which the clip hanger of this invention is used or operated is hereinafter disclosed in conjunction with the attached drawings.

One end of the trouser (D) is carried between the serrated edges of the lateral clamps (3)(3') and held there with one hand, subsequently the elongated loop (C) is slid downward along the outer peripheries of the elongated clamp arms (2)(2') against the resiliency of the joint members (6)(6'), elongated arms (2)(2') and possibly the elongated circular loop (C) until it takes a suitable clamping position as shown in FIG. 2, thereby enabling the lateral clamps (3)(3') to firmly clamp the trouser (D).

As has been described heretofore, the clip hanger of this invention has the following advantages.

(1) The clip body, the hook as well as the loop can be easily molded of a resilient material such as synthetic resin or plastic and they are readily assembled utilizing the resiliency and flexibility of the members, whereby the clip hanger of this invention can be cheaply produced.

(2) The clip hanger of this invention necessitates no spring means for exerting the clamping force. Namely, the firm clamping or suspending force is produced by a simple elastic engagement between elongated arms and loop, both of which are made of resilient material.

What I claim is:

1. A clip hanger for clamping trousers or skirts comprising:

(1) a clip body molded as a single integral piece of plastic having the following elements, (a) a hook mounting base, said base having an opening at the center of said hook mounting base and two lateral protrusions extending upwardly from the upper surface of said mounting base, said protrusions being equally spaced apart from each other with said opening being located between said two protrusions, (b) a pair of elongated clamp arms symmetrically extending downwardly from opposed sides of said hook mounting base, each of said clamp arms having a thick U-shaped cross section for producing sufficient rigidity and resiliency, (c) a pair of thin flexible flat joint members connecting the upper ends of said elongated clamp arms to said opposed sides of said hook mounting base, and (d) a pair of lateral clamps of L-shaped cross section perpendicularly connected to said elongated arms respectively, said lateral clamps having free ends so that when the clamp arms are closed, the free ends face each other, (2) hook means molded as a single integral piece of plastic, said hook means including a shaft portion disposed in said opening formed in said hook mounting base, said shaft portion having a square member disposed above said opening, the width of said square member being narrower than the space between said lateral protrusions and the diagonal length of said square member being wider than said space so that when said square member is located between said two lateral protrusions, free rotation of said hook means is precluded but said hook means is manually and forcibly rotatable when desired as said square member resiliently engages said two lateral protrusions, (3) an elongated plastic circular loop releasably and slidably disposed around said pair of elongated clamp arms for exerting a clamping force between the free edges of said lateral clamps, said loop having a longitudinal width which is narrower or equal to the distance between the outer peripheries of said clamp arms when said lateral clamps are completely engaged with each other and a lateral inner width equal to the width of said clamp arms, whereby said clamp hanger can firmly hold said trousers or skirts by the coupling operation of the resiliency of said elongated clamp arms and said elongated circular loop.

2. A clip hanger according to claim 1, wherein said elongated clamp arms have reinforcing ribs formed on the outer peripheries thereof.

3. A clip hanger to claim 1, wherein said elongated clamp arms and said loop have a width narrower than the width of said hook mounting base so that said loop can be held on said clip body without separation when not in use.

4. A clip hanger according to claim 1, wherein said free ends of said L-shaped lateral clamps are serrated.

5. A clip hanger according to claim 1, wherein said shaft portion has an inverse-cone-shaped latch member formed at the bottom extremity thereof and said latch member has a diameter greater than the diameter of said opening formed on said hook mounting base, whereby after biasingly passing through said opening, said latch member prevents said hanger means from escaping from said clip body.

6. A clip hanger for clamping trousers or skirts comprising:

(1) a clip body molded as a single integral piece of plastic having the following components, (a) a hook mounting base, said base having an opening at the center thereof, said mounting base having two parallel and spaced apart lateral protrusions on the upper surface thereof with said opening being disposed between said two spaced apart protrusions, said mounting base also having a pair of spaced protrusions extending from the bottom surface thereof, (b) a pair of elongated clamp arms symmetrically extending from opposed sides of said hook mounting base, each of said clamp arms having a thick U-shaped cross section for producing sufficient rigidity and resiliency, each of said clamp arms having a protrusion, (c) a pair of thin flexible flat joint members connecting the ends of said elongated clamp arms to said opposed sides of said hook mounting base, said clip body being molded with each of said clamp arms being aligned linearly with said mounting base and with said joint members such that the center line of said clamp arms, said joint members and said mounting base are disposed in a straight line, said clamp arms after initial molding being flexed at said flexible joint members so as to dispose said clamp arms downwardly and outwardly from said mounting base whereby each of said clamp arms is disposed at an obtuse angle relative to said mounting base when said mounting base is generally horizontally disposed, (d) a pair of lateral clamps of L-shaped cross section perpendicularly connected to said elongated arms respectively, said lateral clamps having the horizontal free ends thereof facing each other, (2) a plastic-molded hook means having a lower shaft portion detachably engaged with said opening formed on said hook mounting base, said hook means being provided with a square member above said lower shaft portion which rests between said two lateral protrusions, the space between said lateral protrusions being wider than the width of said square member and narrower than the diagonal length of said square member such that the lateral protrusions normally preclude the hook means from rotating while providing for manually and forcibly rotating said hook means when desired as said square member resiliently engages said two lateral projections, and (3) an elongated plastic circular loop releasably and slidably disposed around said pair of elongated clamp arms for exerting a clamping force between the free edges of said lateral clamps, said protrusions on said clamp arms being located to align with the abut said protrusions on said mounting base to define a minimum folding angle for said clamp arms, said loop having a longitudinal width which is narrower or equal to the distance between the outer peripheries of said clamp arms when said lateral clamps are completely engaged with each other and a lateral inner width equal to the width of said clamp arms, whereby said clamp hanger can firmly hold said trousers or shirts by the coupled operation of the resiliency of said elongated clamp arms and said elongated circular loop.

* * * * *